United States Patent [19]

Elkuch et al.

[11] Patent Number: 4,741,512

[45] Date of Patent: May 3, 1988

[54] LIFTING DEVICE OR LOAD-SUPPORTING APPARATUS

[76] Inventors: Harald Elkuch, Oberbühl 166, FL-9487 Bendern, Liechtenstein; Sigmund Elkuch, Brunnenstr. 5, CH-9470 Buchs, Switzerland

[21] Appl. No.: 2,664

[22] PCT Filed: Apr. 16, 1986

[86] PCT No.: PCT/CH86/00050

§ 371 Date: Dec. 8, 1986

§ 102(e) Date: Dec. 8, 1986

[87] PCT Pub. No.: WO86/06053

PCT Pub. Date: Oct. 23, 1986

[30] Foreign Application Priority Data

May 16, 1985 [CH] Switzerland ..... 1610/85

[51] Int. Cl.[4] ..... B66F 3/22

[52] U.S. Cl. ..... 254/9 C; 254/122; 248/421

[58] Field of Search ..... 248/588, 421; 280/32.6; 108/147, 145, 144, 136; 254/122, 9 R, 9 B, 9 C

[56] References Cited

U.S. PATENT DOCUMENTS

| | | | |
|---|---|---|---|
| 1,327,103 | 1/1920 | Knowles . | |
| 3,096,059 | 7/1963 | Johnson . | |
| 3,116,910 | 1/1964 | Moore . | |
| 3,645,488 | 2/1972 | Sturhan | 248/588 |
| 4,558,648 | 12/1985 | Franklin et al. | 248/588 |
| 4,659,052 | 4/1987 | Nagata | 248/588 |

FOREIGN PATENT DOCUMENTS

| | | |
|---|---|---|
| 1806380 | 6/1970 | Fed. Rep. of Germany . |
| 1920696 | 11/1970 | Fed. Rep. of Germany . |
| 3138717 | 6/1983 | Fed. Rep. of Germany . |
| 2058802 | 5/1971 | France . |
| 2167190 | 8/1973 | France . |
| 2282575 | 3/1976 | France . |
| 473731 | 7/1969 | Switzerland . |
| 551813 | 3/1943 | United Kingdom . |
| 2055754 | 3/1981 | United Kingdom . |

*Primary Examiner*—Robert C. Watson

*Attorney, Agent, or Firm*—McAulay, Fields, Fisher, Goldstein & Nissen

[57] ABSTRACT

Lifting device or load-supporting apparatus for use in workshops. The apparatus is connected to a stand arranged on the floor by means of scissor-like connecting rods, at least two of the connecting rods are each coupled to an axle carried by the stand. The height of the rods are adjustable via at least two spring units which has a completely relaxed starting position. The two spring units are each connected to a bearing and an abutment over the entire lifting height of the load-supporting apparatus. A locking apparatus is associated with the spring units which permits the starting position of at least one spring unit to be fixed at different lifting heights.

20 Claims, 3 Drawing Sheets

FIG. I

LIFTING DEVICE OR LOAD-SUPPORTING APPARATUS

Figure 1:
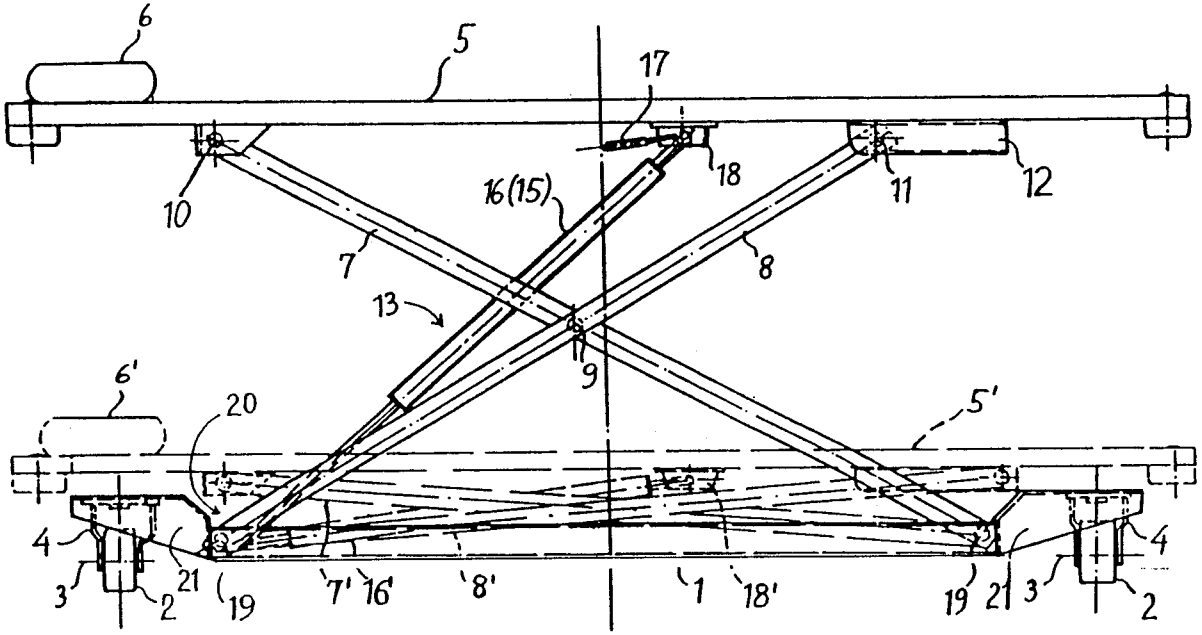

The invention relates to a load-supporting apparatus.

More particularly, the load-supporting apparatus according to the invention is concerned with an apparatus which is connected to a stand arranged on the floor by means of scissor-like connecting rods; at least two of the connecting rods are each coupled to an axle borne by the stand, and the height of which is adjustable via at least two spring units, each of which has different characteristics and each of which has a starting position in which it is completely relaxed ro relaxed to a maximum extent, and a bearing is assigned to one end of each spring unit and an abutment to the other end of each spring unit.

Load-supporting apparatuses of this type are frequently used in workshops and especially in garages and automobile repair shops. A typical example of such a load-supporting apparatus is described in German Offenlegungsschrift No. 3,240,952, in which the lifting unit has at least one hydraulic cylinder. Since the connecting rods, which have a scissor-like arrangement, necessarily lead to non-linear characteristics for the loading of the lifting unit during the movement of the load-supporting apparatus - formed in this case by two rails - and, this publication proposes operating the lifting unit under different pressures. This is possible without problems in the case of fluid motors of this type. However, for handling relatively small loads, for example in automobile workshops for lifting apparatuses for a mechanic lying underneath a chassis, a fluid (i.e. hydraulic or pneumatic) lifting apparatus with a fluid reservoir and pump is a relatively expensive matter.

This also applies to a design according to German Pat. No. 2,941,454, in which, in order to avoid relatively high loading of the lifting unit at the beginning of the lifting movement, i.e. at the lower end of the path travelled by the load-supporting apparatus, the vertical piston rod of the hydraulic cylinder unit acts on the hinge point of the scissors in the middle of two connecting arms connected to one another by a hinged joint. Although this makes it possible to avoid increased loading of the lifting unit at the lower end, a load peak occurs at the upper end. In this case too, the hydraulic system would be relatively expensive.

U.S. Pat. No. 3,096,059 and EP-A No. 0 142 919, which has not previously been published, have disclosed load-supporting apparatuses of the type stated at the outset, these designs on the one hand making it possible to avoid an expensive driving hydraulic system and on the other hand providing a certain degree of compensation for the load differences arising from the connecting rod geometry, by means of an additional spring which comes into contact, only toward the end of the downward movement of the load-supporting apparatus, with its abutment on the said apparatus (U.S. Pat. No. 3,096,059) or on the stand (EP-A No. 142,919). The locking apparatus is in the form of a brake in the case of the design according to the U.S. proposal, but it is completely missing in the case of EP-A No. 142,919, because here the load-supporting apparatus need only be adjusted between a fully collapsed and a fully extended position; in fact, it is only intended to serve as a support for a television or the like. A similar application is intended in the case of the US-A too, so that in both cases the forces acting on the springs will be fairly constant.

It is the object of the invention to design a load-supporting apparatus for relatively small loads in an economical manner and in such a way that it can be adjusted for different loads. This is achieved, according to the invention, by connecting the spring units, (15,16) to a bearing and an abutment over the entire lifting height of the load-supporting apparatus (5); and locking apparatus (17) is in the form of an adjusting means which permits the starting position of at least one spring unit (15 or 16) to be fixed at different lifting heights of the load-supporting apparatus (5).

Spring units having locking devices in the form of pneumatic springs are known per se for other purposes, for example for office chairs. The initial height from which the spring can be compressed, or the starting position from which the spring makes a relaxing movement after the locking apparatus has been unlocked, can be selected with the aid of the locking apparatus. However, these measures alone do not mean that such a spring arrangement can be used in an expedient manner on a load-supporting apparatus of the type stated at the outset, since it is in fact the non-linear characteristic of the load in the case of a scissors movement and the adjustability to different loads which have to be taken into account; this is the purpose of the invention.

This is because the non-linear characteristic of the spring units in conjunction with the fact that the spring units are constantly connected to the bearing and abutment (and do not come into contact with a stop surface, which forms the abutment, only at the end of the lifting movement), and the adjustability of the starting position, mean that, depending on the setting, some of the forces exerted by the spring units are additive in one case and subtractive in the other, as will be evident from the description. This results in different total forces. In this case, therefore, the locking apparatus has a very different function from that of the prior art.

It would of course be possible for at least one of the springs to be in the form of, for example, a helical spring and for its bearing to be fixed at different positions, for example along an adjusting rail, in order to obtain adjustability in this way. However, this can be accomplished in a simpler manner if at least one of the spring units having a different characteristic is in the form of a pneumatic spring with a cylinder, a piston and a piston rod.

In order to be able to obtain a particularly flat spring characteristic and a large spring displacement, the two spring units, which are preferably in the form of pneumatic springs, are advantageously arranged so that they connect the stand directly to the load-supporting apparatus. In addition or alternatively, at least one spring unit can have (for the same purpose) its bearing on one of the axles of the connecting rods, in particular on an axle connected to the stand, since this spring unit—when the load-supporting apparatus is in the extended state—assumes an inclined position, and the spring displacement is therefore longer. Moreover, this also makes it easier to accommodate the spring unit when the load-supporting apparatus is in the fully collapsed state and thus reduces the overall height of the load-supporting apparatus including the stand.

With regard to the latter purpose, it is also useful if the stand has a U-shaped depression in the middle, into which the spring units can be lowered when the load-supporting apparatus is in the lowered position. Preferably, rollers are provided underneath the upward-pointing U limbs of the stand; these rollers can be arranged, for example, adjacent to the springs lowered into the depression (instead of underneath these springs).

Further details of the invention are evident from the following description of an embodiment illustrated schematically in the drawing.

Figure 2:
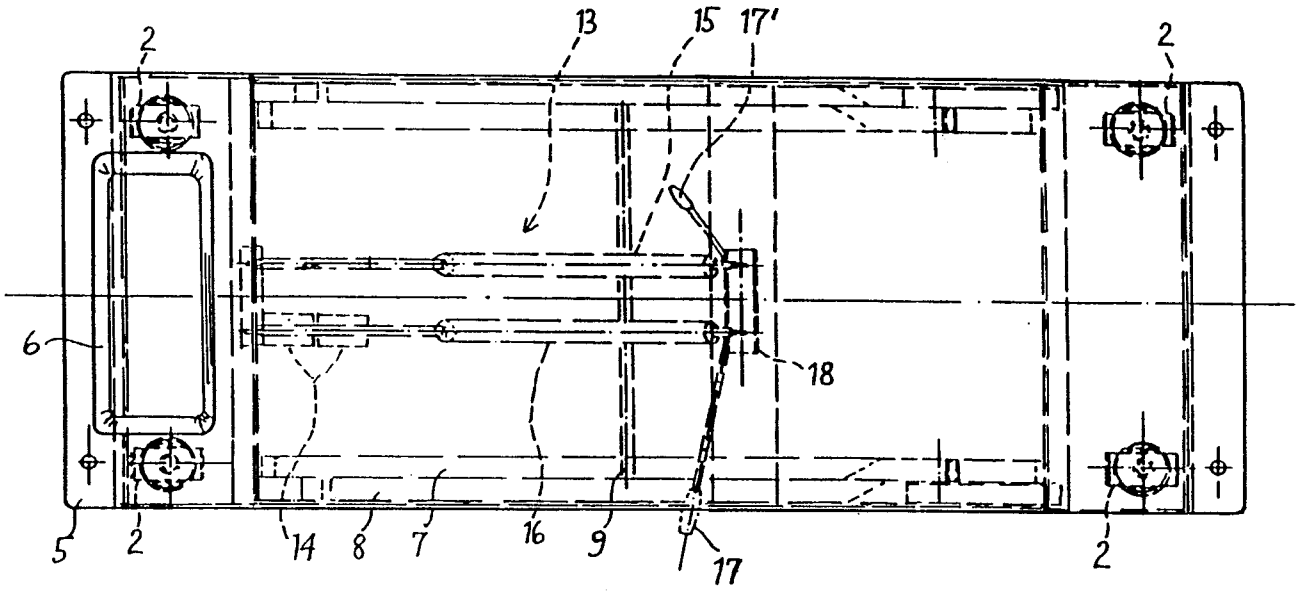
Figure 3:
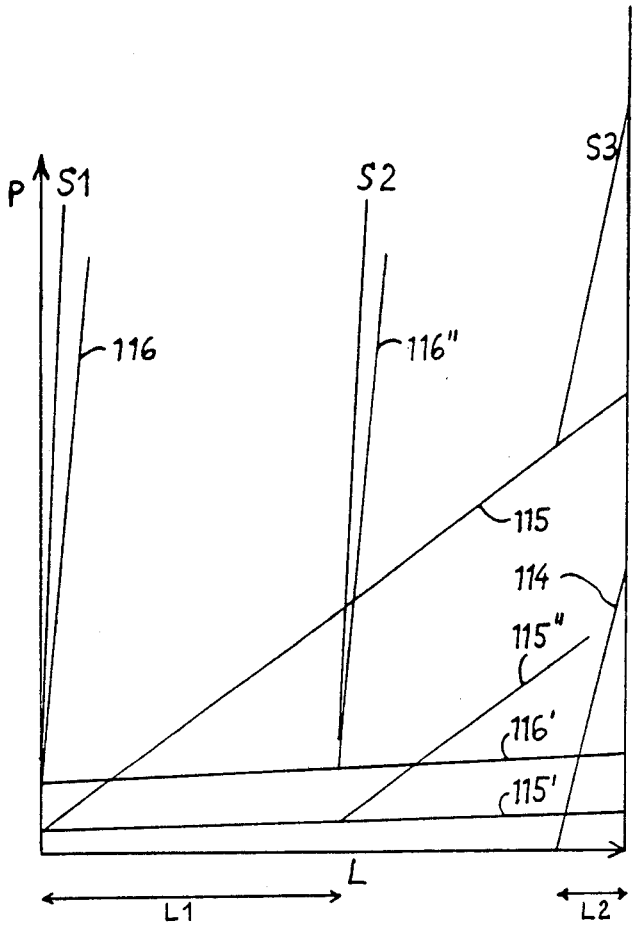

FIG. 1 shows a side view of an embodiment of a lifting apparatus in the raised position, the lowered position being indicated by dashed lines, FIG. 2 shows a plan view of the lifting apparatus of FIG. 1, and FIG. 3 shows a graph illustrating the spring characteristics of the spring units used in the embodiment according to FIG. 1 and 2.

A stand 1 can be moved on wheels 2. Each wheel 2 is mounted on a swivelling bolster 4 which can be rotated about an axis 3. For elevating trucks in sewage pipes, however, the wheels may furthermore be arranged rigidly and at a suitable angle to the horizontal. A load-bearing platform 5, which serves, for example, to support a mechanic when he is working in a prostrate position underneath the chassis of a car, is mounted on the upper side of the stand 1. For this reason, the platform 5 is provided with a pillow 6.

To adapt to chassis of different heights, for example chassis of trucks and automobiles, the platform 5 should be capable of being adjusted in height. For this purpose, two pairs of connecting rods 7, 8 are fastened at their lower end to axles 19 on the stand 1 and at their upper end to the platform 5, by means of hinged joints. Both pairs of connecting rods 7, 8 are connected to one another in the form of scissors by means of a central joint 9. While the upper joint 10 of the connecting rod 7 is fastened to the platform 5, the upper joint 11 of the connecting rod 8 slides in a rail 12. If desired, it is also possible in principle to provide rails for each of the joints 10, 11. It would also be possible to provide a further pair of connecting rods at the upper end of connecting rods 7, 8 and thus form double scissors. All these parts conform to the prior art and can be varied according to the prior art.

The platform 5 can be brought from the position indicated in FIG. 1 by solid lines, where it is at its maximum height, to the lowest position, which is represented by dashed lines and in which all parts have the same reference symbols but with a prime. A spring apparatus 13, which acts as a pressure spring with respect to a load and consists of three cooperating spring units 14, 15 and 16 serves as the drive.

In order not to lose in terms of overall height as a result of the thickness of the spring units 14–16 when the load-supporting apparatus 5 is in the lowered position, the stand 1 is provided in the middle with a broad depression 20 resembling a U shape (cf. FIG. 1); the spring units 14–16 can be lowered into the said depression so that—as indicated by the dashed line the—the load-supporting apparatus 5 can then rest directly on the U limbs 21. lhese U limbs 21 project upward to a slight extent from the lower level of the stand 1 and thus cover the rollers 2 arranged underneath.

Where spring units are mentioned here, the term is intended to express the fact that these need not be springs in the narrower sense of the word, i.e. in the form of helical or leaf springs or the like, but that any apparatus which has a spring action can be used here.

In the embodiment shown, the spring units 15 and 16 are formed by adjustable and lockable pneumatic springs, as in a preferred embodiment. It is expedient to use commercially available pneumatic springs in which a spill valve (not shown) can be opened, for example with the aid of a control lever 17, so that, for example, the springs 16 are compressed, with a slight resistance, under the load of the platform 5 and can thus be brought into any desired starting position. In this position, the lever 17 is then released again, with the result that the spill valve closes and the relevant pneumatic spring 16 has adjusted to the new length.

In this way, the starting position of at least one of the spring units, preferably at least the unit with the less steep characteristic, i.e. the spring 15 (as will be explained below), expediently both springs 15, 16, is adjustable and can be fixed by means of the locking apparatus 17. However, it should be emphasized that both spring units 15, 16 always remain connected, over the entire displacement of the load-supporting apparatus 5, to their bearing on the axle 19 on the stand 1 on the one hand and to their abutment 18 on the load-supporting apparatus 5 on the other hand.

FIG. 3 illustrates the curves for the spring forces. In this figure, the characteristics of the three spring units are shown in terms of the spring force P and the spring displacement L, the overall characteristic S of the spring unit 13 being obtainable from the relevant cumulative curves. Each line corresponding to a spring characteristic has the reference symbol of the associated spring plus 100.

The load-supporting apparatus according to the invention functions as follows. As a first precondition, it is assumed that the spring unit 13 is designed so that, in the open state, i.e. when the spring displacement is zero, that is to say when the load-supporting apparatus 5 is in the raised position, it supports a load (e.g. a man) of 90 kg. If the man wishes to lower himself, he operates the lever 17 and hence the spill valve of the powerful pneumatic spring 16 with the steep characteristic 116, with the result that the characteristic shifts to the line 116', until he has reached the desired height by means of the spring displacement L1, whereupon he releases the lever 17 again. Consequently, the characteristic of the powerful pneumatic spring shifts to position 116''. The pneumatic spring is now locked at the new height for the same weight, or the same force of 90 kg. However, the weaker pneumatic spring 15 with the flatter characteristic now acts in such a way that the resilience range is increased in comparison with the starting position because the pneumatic spring 15 presses upward and the pneumatic spring 16 locked at the new height tries to pull upward, the weight of the man acting against both springs. If it is intended to raise the load-supporting apparatus 5 again, the man reduces the force acting on the load-supporting apparatus 5 only slightly by pulling with one hand on the chassis above him or pressing down against the stand 1, or by supporting himself on the floor with his legs. lf he simultaneously operates the lever 17 with the other hand, the powerful pneumatic spring 16 with the steep characteristic 116 will then force the load-supporting apparatus 5 upward again. In this position, he releases the lever 17, and his entire weight will be supported again in the upper position (characteristic 116).

If it is then intended that the load-supporting apparatus be used by a smaller load, for example a man weighing only 70 kg, at the stated setting the load-supporting apparatus 5 would not fall under the smaller weight, despite operation of the lever 17. To adjust the spring unit 13 in this case, the man increases the force acting on the platform 5 only slightly by pulling downward with one hand on the stand 1 or pushing upward against the chassis above him while operating the lever 17 with the other hand; this lowers the load-supporting apparatus 5 to a somewhat lower level, for example likewise through the spring displacement L1, whereupon he releases the lever 17 again and thus provisionally locks the set height. By means of a similar lever 17', he then operates the spill valve of the weaker pneumatic spring 15 with the flatter characteristic 115. The characteristic then shifts to the line 115' and adjusts the spring unit 13 to the lower load/force corresponding to the relevant height. The overall characteristic S2 results. The platform 5 can now be raised again by reducing the load slightly and operating the lever 17, as described above, and the pneumatic spring 15 must be pulled by the other pneumatic spring 16 beyond the height previously set; this spring loses some of its force to the spring 15, with the result that the spring unit 13 is now adjusted to a lower load.

It must be stated that, in FIG. 3, the curves for the spring characteristics are merely theoretical and illustrated schematically, and may differ in relation to one another. Furthermore, the force available for the displacement is of course smaller than the spring force shown in the graph owing to the geometry of the connecting rods, this deviation being greater or lesser depending on the height set.

In a practical embodiment, the total possible spring displacement of the pneumatic springs 15 and 16 may be about 150 mm, the initial force of the spring 16 may be 75 kg, its final force (when the spill valve is open) may be about 100 kg, the initial force of the spring 15 may be approximately 25 kg and its final force (when the spill valve is closed) may be, for example, 450 kg.

The final force (for the lower end of the displacement of platform 5) is further increased by the characteristic 114 of the spring 14 in a non-linear manner to give the overall characteristic S3. In fact, this spring 14 has only a small spring displacement L2 and is furthermore very steep, so that, for the displacement from the lower to the upper position, it gives rise to initial forces which may reach almost 1 ton, for example 900 kg. Although the lifting apparatus shown in FIGS. 1 and 2 is intended only for the weight of a man, the spring forces required to compensate the non-linear load, which is based on a trigonometric function and is due to the connecting rod geometry of the coupled spring unit 13, and to compensate the upward-acting force component, which is initially very small, must be relatively large. Of course, the overall characteristic shown in FIG. 3 cannot constitute an exact compensation of the load characteristic but will be sufficient for the normal case. If an arrangement is desired in which the load characteristic is completely compensated, i.e. the spring forces act uniformly upward at (at least almost) every point along the spring displacement, the trigonometric function of the load characteristic can be smoothed by arranging further springs which are similar to spring 14 and have a shorter spring displacement, so that, instead of the bend in the curves 115, 114, a plurality of such bends are obtained as a result of a gradation of spring displacements of various lengths.

In the case of the pneumatic springs 15, 16, adjustment can be effected by means of the locking apparatus itself, since this apparatus can be used to set the initial position from which the pneumatic spring is effective. However, it is also possible to provide a separate adjusting means, this being done particularly where other spring units are used. Thus, the upper spring bearing 18 may be mounted so that it can be displaced in the longitudinal direction of the platform 5, the said bearing being capable of being fixed in different positions. Adjustment of the height of the upper and/or lower spring bearing is also possible.

It is preferable if the rubber elements 14 are arranged on the piston of the more powerful pneumatic spring 16 with the steeper characteristic, because in this case the joints by means of which the two pneumatic springs 15, 16 are attached to the stand 1 are subjected to loads which differ to a smaller extent. The advantage of this arrangement will become clear straight away if, when comparing the two extreme positions shown in FIG. 1, it is borne in mind that, in the lower position, the cylinder of the pneumatic spring 16' comes into contact with and compresses the spring 14 (in contrast to FIG. 2). When, under the action of a force, the platform 5 is lowered to such an extent that the spring 14 is compressed by the cylinder of the pneumatic spring 16', the pressure spring 14 is subjected to stress and stores power, which it gives up again at the beginning of the lifting movement when the locking apparatus is released by operating the lever 17. Because of the geometry of the coupling of the pneumatic springs 15, 16 to the stand 1 and to the platform 5, only a small force component will act upward at the beginning of the displacement, whereas the larger force component acts parallel to the plane of the platform 5 and is thus useless. It is therefore advantageous if, to compensate this non-linear load characteristic, the spring 14 additionally acts in the region in which the load is greatest for the spring unit 13. Further compensation is obtained by combining the two pneumatic springs 15, 16 of different characteristics. In a simplified embodiment comprising a total of only two spring units, the compensation is less successful. On the other hand, in order to achieve better compensation of the non-linear load characteristic, it may be desirable in special cases to provide additional spring elements. Thus, the design may be such that each of the two parts of the spring 14 in turn has a different characteristic. If necessary, a third spring may furthermore extend parallel to the pneumatic springs 15, 16 or in another direction.

A large number of modifications are possible within the scope of the invention; for example, although arranging the spring 14 on the piston rod of a pneumatic spring is simple from a constructional point of view and advantageous, it is also possible to adopt a different arrangement, for example one in which, at the lower end of the downward movement of the platform 5, a spring of this type having a short displacement comes into contact with platform 5 itself or with another part connected to platform 5. While this is the simplest method of bringing the spring 14 into effect in the correct phase of movement, there are also other possibilities, for example subjecting a spring corresponding to spring 14 to tension by means of another spring during the upward movement and then releasing it at the correct time for contact. However, this requires a corresponding outlay for gears and would probably be appropriate to employ if it is intended to use a geometric arrangement as disclosed in German Pat. No. 2,941,454. Hence, the coupling illustrated, of the springs 15, 16, in particular together with the spring 14, is preferred since it manages without complicated gears. In the case of double scissors, it would also be possible, as already mentioned, for at least one spring unit to be stretched between the outer ends of the connecting rods, in which case a tension spring would be used instead of the pressure springs described here.

We claim:

1. Load-supporting apparatus which is connected to a stand arranged on the floor by means of scissor-like connecting rods, of which at least two connecting rods are each coupled to an axle borne by the stand, and whose height can be adjusted via at least two spring units which have different characteristics and each of which has a starting position in which it is completely relaxed, a bearing being assigned to one end of each spring unit and an abutment to the other end, wherein the two spring units (15,16) are each connected to a bearing and an abutment over the entire lifting height of the load-supporting apparatus (5), and the locking apparatus (17) is in the form of an adjusting means which permits the starting position of at least one spring unit (15 or 16) to be fixed at different lifting heights of the load-supporting apparatus (5); and at least the spring unit (15) with the less steep characteristic (115) and lower initial spring force has a starting position which can be fixed at various lifting heights and is therefore adjustable in respect of the force exerted on the load-supporting apparatus (5) in the direction of lifting.

2. Load-supporting apparatus as claimed in claim 1, wherein a locking apparatus (17) is assigned to each spring unit (15, 16), and the starting positions of the two spring units (15, 16) can be assigned to different lifting heights of the load-supporting apparatus (5).

3. Load-supporting apparatus as claimed in claim 1, wherein at least one spring unit (15, 16) has its bearing on one of the axles of the connecting rods (7,8), in particular on an axle connected to the stand (1).

4. Load-supporting apparatus as claimed in claim 1, wherein at least one third pressure spring (14) which presses against its abutment in an end part of the movement of the load-supporting apparatus (5), in particular in the lower part, is provided, and this pressure spring (14) is preferably arranged on the piston rod of a pneumatic spring (15, 16) whose cylinder forms the abutment, this pressure spring (14) expediently being arranged on the piston rod of the spring unit (16) with the steeper characteristic (116).

5. Load supporting apparatus as claimed in claim 4, wherein at least one of said spring units (15) has a less steep characteristic (115) and a lower initial spring force force such that a starting position thereof can be fixed at various lifting heights and is adjustable in respect of the force on the load-supporting supparatus (5) in the direction of lifting.

6. Load supporting apparatus as claimed in claim 5, wherein each said spring unit (15, 16), is associated with said locking apparatus (17) for controlling the starting positions of said two spring units (15, 16) so that different lifting heights can be assigned to each of said spring units.

7. Load supporting apparatus, comprising:

scissor-like connecting rods for connecting the apparatus to a stand (1) arranged on a floor;

at least two of said connecting rods each being coupled to an axle borne by the stand;

at least two spring units operatively associated with said connecting rods for adjusting the height of said connecting rods;

each of said spring units having different characteristics and each of which has a starting position in which it is maximum relaxed;

a bearing assigned to one end of each said spring unit and an abutment to the other end;

each of said two spring units (15, 16) being connected to a bearing and an abutment over the entire lifting height of the load-supporting apparatus (5), and adjusting means including a locking apparatus (17) for fixing the starting position of at least one said spring unit (15 or 16) at different lifting heights of the load-supporting apparatus (5).

8. Load supporting apparatus as claimed in claim 7, wherein the pressure spring (14) has a steep characteristic (114) and a short spring displacement and is preferably in the form of a rubber element.

9. Load supporting apparatus as claimed in claim 8, wherein each said spring unit (15, 16) is associated with said locking apparatus (17) for controlling the starting positions of said two spring units (15, 16) so that different lifting heights can be assigned to each of said spring units.

10. Load supporting apparatus as claimed in claim 9, wherein at least one of said spring units (15, 16) has a different characteristic and is in the form of a pneumatic spring with a cylinder, a piston and a piston rod.

11. Load supporting apparatus as claimed in claim 10, wherein said stand (1) has a pair of upward pointing legs and a central U-shaped depression into which the spring units are lowered when the load-supporting apparatus (5) is in its collapsed state, and including rollers (2) underneath said upward pointing legs.

12. Load supporting apparatus as claimed in claim 7, wherein said stand (1) has a pair of upward pointing legs and a central U-shaped depression into which the spring units are lowered when the load-supporting apparatus (5) is in its collapsed state, and including rollers (2) underneath said upward pointing legs.

13. Load supporting apparatus as claimed in claim 7, wherein at least one of said spring units (15, 16) has a different characteristic and is in the form of a pneumatic spring with a cylinder, a piston and a piston rods; said two spring units (15, 16) connect the stand (1) directly to the load-supporting apparatus (5); and including connecting rods (7, 8) and at least one said spring unit (15, 16) has its bearing on one of the axles of said connecting rods (7, 8).

14. Load-supporting apparatus as claimed in claim 7, wherein at least one third pressure spring (14) which presses against its abutment in an end part of the movement of the load-supporting apparatus (5), in particular in the lower part, is provided, and this pressure spring (14) is preferably arranged on the piston rod of a pneumatic spring (15, 16) whose cylinder forms the abutment, this pressure spring (14) expediently being arranged on the piston rod of the spring unit (16) with the steeper characteristic (116).

15. Load supporting apparatus as claimed in claim 7, wherein at least one of said spring units (15) has a less steep characteristic (115) and a lower initial spring force such that a starting position thereof can be fixed at various lifting heights and is adjustable in respect of the force on the load-supporting apparatus (5) in the direction of lifting.

16. Load supporting apparatus as claimed in claim 15, wherein each said spring unit (15, 16) is associated with said locking apparatus (17) for controlling the starting positions of said two spring units (15, 16) so that different lifting heights can be assigned to each of said spring units.

17. Load supporting apparatus as claimed in claim 13, wherein said stand (1) has a pair of upward pointing legs and a central U-shaped depression into which spring units are lowered when the load-supporting apparatus (5) is in its collapsed state, and including rollers (2) underneath said upward pointing legs.

18. Load supporting apparatus as claimed in claim 14, wherein the pressure spring (14) has a steep characteristic (114) and a short spring displacement and is preferably in the form of a rubber element.

19. Load-supporting apparatus as claimed in claim 18, wherein at least one of said spring units (15, 16) has a different characteristic and is in the form of a pneumatic spring with a cylinder, a piston and a piston rod.

20. Load supporting apparatus as claimed in claim 7, wherein each said spring unit (15, 16) is associated with said locking apparatus (17) for controlling the starting positions of said two spring units (15, 16) so that different lifting heights can be assigned to each of said spring units; and at least one of said spring units (15, 16) has a different characteristic and is in the form of a pneumatic spring with a cylinder, a piston and a piston rod; and whereby the pneumatic springs contain a spill valve which is directly associated with said locking apparatuses.

* * * * *